US008561439B2

(12) United States Patent
Lee et al.

(10) Patent No.: US 8,561,439 B2
(45) Date of Patent: Oct. 22, 2013

(54) FABRIC TREATING MACHINE

(75) Inventors: Hyuk Soo Lee, Changwon-si (KR); Tae Hee Lee, Changwon-si (KR); Young Jong Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 886 days.

(21) Appl. No.: 12/708,097

(22) Filed: Feb. 18, 2010

(65) Prior Publication Data

US 2010/0212370 A1 Aug. 26, 2010

(30) Foreign Application Priority Data

Feb. 25, 2009 (KR) ..... 10-2009-0015925

(51) Int. Cl.
*D06F 37/30* (2006.01)

(52) U.S. Cl.
USPC ..... 68/140; 68/142; 68/133

(58) Field of Classification Search
USPC ..... 68/140, 142–143, 133; 310/348, 350
See application file for complete search history.

(56) References Cited

U.S. PATENT DOCUMENTS

| | | | | | |
|---|---|---|---|---|---|
| 2,893,264 | A * | 7/1959 | Gibson | 74/664 |
| 3,845,642 | A * | 11/1974 | Cochran | 68/23.7 |
| 5,381,677 | A * | 1/1995 | Park et al. | 68/23.7 |
| 5,551,261 | A * | 9/1996 | Lyu et al. | 68/23.6 |
| 7,320,185 | B2 * | 1/2008 | Heyder et al. | 34/602 |
| 2008/0289370 | A1 * | 11/2008 | Byun et al. | 68/140 |

FOREIGN PATENT DOCUMENTS

| | | | |
|---|---|---|---|
| KR | 10-1999-003436 | A | 1/1999 |
| KR | 2003050291 | A * | 6/2003 |
| KR | 10-2006-0009075 | A | 1/2006 |

* cited by examiner

*Primary Examiner* — Michael Barr
*Assistant Examiner* — Kevin G Lee
(74) *Attorney, Agent, or Firm* — Birch, Stewart, Kolasch & Birch, LLP

(57) ABSTRACT

A fabric treating machine according to the present invention comprises a connector which is disposed at an outer tub and is connected to a driving part which is disposed at either the center or the off-center position of the connector optionally. Therefore, not only the direct driving motor but the indirect driving motor can be disposed without change of the outer tub and the connector. Because the common use of the outer tub is possible regardless of the connecting method of the driving part, there are the advantages that the cost is reduced and productivity and assembly are improved.

10 Claims, 5 Drawing Sheets

FABRIC TREATING MACHINE

This application claims priority from Korean Patent Application No. 10-2009-0015925 filed on Feb. 25, 2009, in the Korean Intellectual Property Office, the disclosure of which is incorporated herein by reference in its entirety.

BACKGROUND OF THE INVENTION

1. Field of the Invention

The present invention relates to a fabric treating machine, and more particularly, to a fabric treating machine which comprises a outer tub which can be used for common regardless of the connecting method of the motors such as a direct driving motor and a indirect driving motor.

2. Description of the Conventional Art

Generally a fabric treating machine is a device to washes or dries the laundry. Also the fabric treating machine is classified with a direct driving type and an indirect driving type according to driving method of an inner tub which is accommodated the laundry. A direct driving motor is used in the direct driving type. An indirect driving motor is used in the indirect driving type. In the indirect driving type, a driving power of the indirect driving motor is transmitted to the inner tub by a belt. A shape of an outer tub which is connected to the indirect driving motor is significantly different from a shape an outer tub which is connected to the direct driving motor.

Thus, it is impossible that the direct driving motor cannot connect to the outer tub which is designated for the indirect driving motor only. Also, it is impossible that the indirect driving motor cannot connect to the outer tub which is designated for the direct driving motor only.

There are problems that the production cost is high, because the shape of the outer tub varies according to the connecting method of the motor and the outer tube is not compatible.

SUMMARY OF THE INVENTION

An object of the present invention is to provide a fabric treating machine which an outer tub is able to be used for common.

A fabric treating machine according to the present invention comprises a cabinet, which includes a hole for inserting fabrics through the top surface, and a outer tub, which is deposed inside of the cabinet to accommodate wash water, and an inner tub, which is disposed inside of the outer tub to accommodate fabrics, and a rotary shaft, which is connected with the inner tub to rotate the inner tub, and a driving part, which generates and transmits driving power to rotate the rotary shaft, and a connector, which is disposed at the outer tub and is formed for the driver to be disposed at either the center or the off-center position of the connector optionally.

According to an aspect of the present invention, the connector may comprise a bracket which is fixed on the bottom surface of the outer tub.

According to an aspect of the present invention, the connector may comprise a direct driver placement which is disposed at the center of the connector and is formed for the driver to be placed on when the driver connects to the rotary shaft directly, and a indirect driver placement which is extended from the direct driver placement toward the both end sides and is formed for the driver to be placed on when the driver indirectly connects to the rotary shaft by a extra connecting parts.

According to an aspect of the present invention, the driving part may comprise a direct driving motor which is placed on the direct driver placement.

According to an aspect of the present invention, the driving part may comprise the indirect driving motor which is placed on the indirect driver placement, and the extra connecting parts may comprise a pulley which is connected to the rotary shaft and a belt which connects the indirect driving motor to the pulley and transmits the driving power.

According to an aspect of the present invention, the direct driver placement may comprise a through hole which the shaft of the driver passes through.

According to an aspect of the present invention, the indirect driver placement may comprise a guide groove which is extended from the direct driver placement toward the both sides and is formed concave toward the outer tub.

According to an aspect of the present invention, the bottom surface of the outer tub may form the concave groove to match the guide groove.

According to an aspect of the present invention, the connector may comprise the reinforcement part which is extended from the direct driver placement toward the radial direction and reinforce the stiffness.

According to an aspect of the present invention, the reinforcement part may be circular in shape.

A fabric treating machine according to the present invention comprises a connector which is disposed at an outer tub and is connected to a driving part which is disposed at either the center or the off-center position of the connector optionally.

Therefore, not only the direct driving motor but the indirect driving motor can be connected without change of the outer tub and the connector. Because the common use of the outer tub is possible regardless of the connecting method of the driving part, there are the advantages that the cost is reduced and productivity and assembly are improved.

Also, there is an advantage that the stiffness is reinforced by increasing the contact area with the outer tub, as the fabric treating machine further comprises the reinforcement part which is extended from where the driving part is placed.

DETAILED DESCRIPTION OF THE PREFERRED EMBODIMENT

The above and other advantages of the present invention will become more apparent by describing in detail embodiments thereof with reference to the attached drawings in which.

The present invention is not restricted by the following embodiments. It will be understood by those of ordinary skill in the art that various changes in form and details may be made therein without departing from the spirit and scope of the present invention as defined by the following claims.

Figure 1:
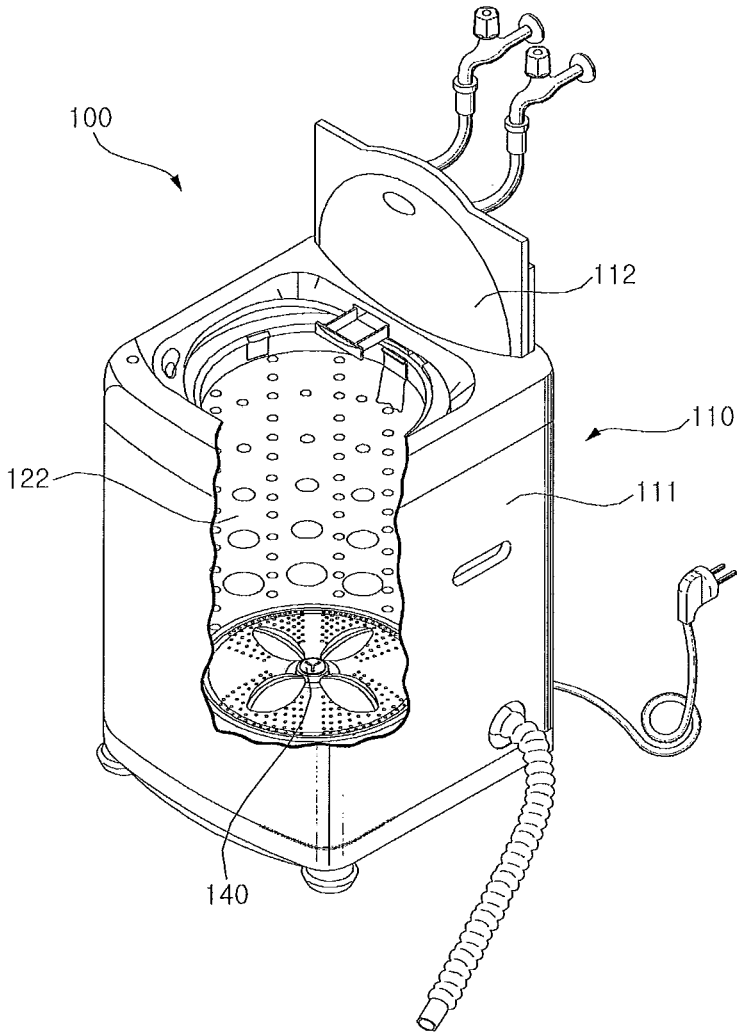
FIG. 1 is a perspective view which illustrates a fabric treating machine according to an exemplary embodiment of the present invention.
Figure 2:
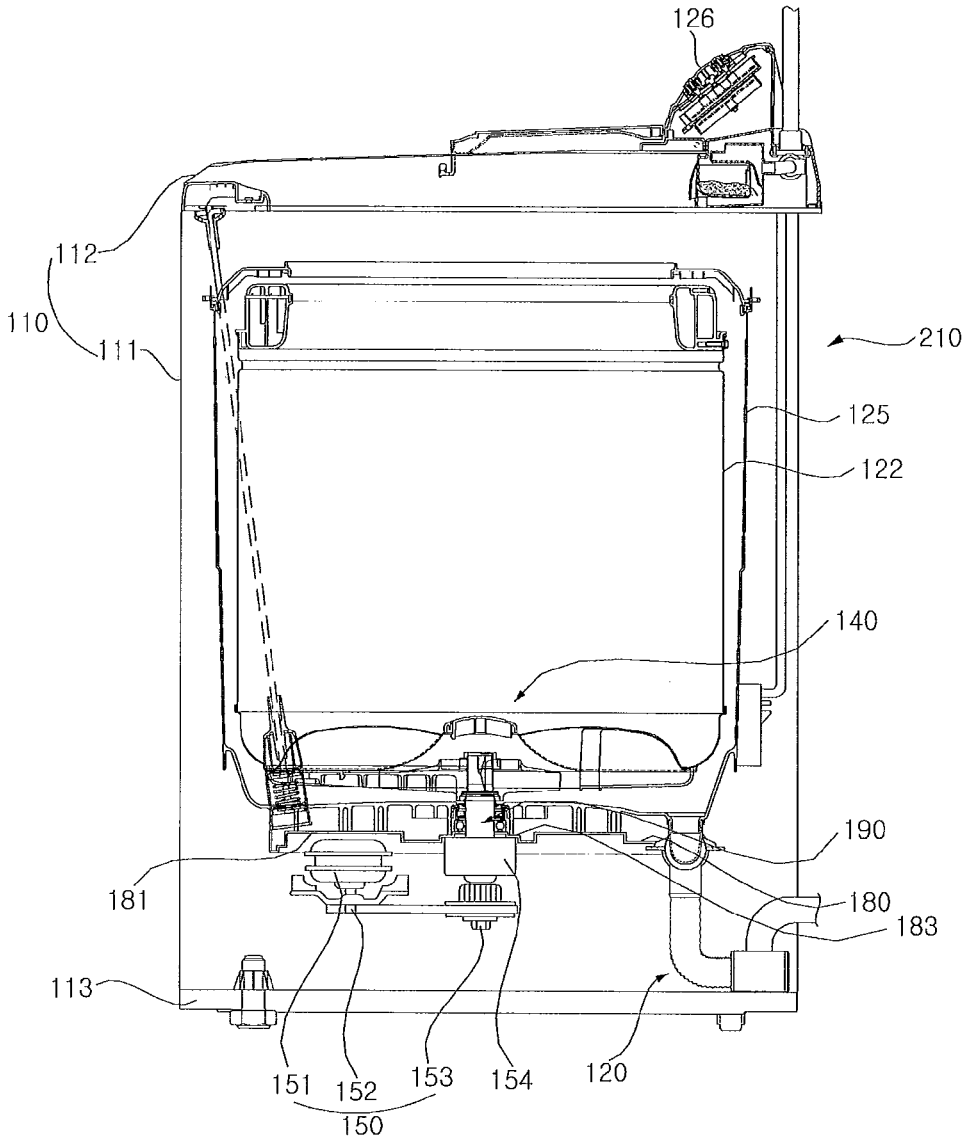
FIG. 2 is a longitudinal section view which illustrates the fabric treating machine comprising an indirect driving motor according to an exemplary embodiment of the present invention.

FIG. 1 is a perspective view which illustrates a fabric treating machine according to an exemplary embodiment of the present invention. FIG. 2 is a longitudinal section view which illustrates the fabric treating machine comprising an indirect driving motor according to an exemplary embodiment of the present invention.

Referring to FIG. 1 and FIG. 2, a fabric treating machine 100 according to the present invention comprises a cabinet 110, and a wash water supplier (not shown) which wash water is supplied from the outside of the fabric treating machine 100, and an outer tub 125 which accommodates wash water which is flowed from the wash water supplier, and an inner tub 122 which is disposed inside of the outer tub 125 to accommodate fabrics, and a rotary shaft 190 which is connected with the inner tub 122 to rotate the inner tub 122, and a driving part 150/250 which generates and transmits driving power to rotate the rotary shaft 190, and a drainage device 120 which discharges the wash of the outer tub 125 to the outside of the fabric treating machine 100. The cabinet 110 comprises a cabinet body 111, which includes an opening on the top surface, and a base 113, which is disposed at the bottom of the cabinet body 111, and a cabinet cover 112, which is disposed at the top of the cabinet body 111. The cabinet cover 112 includes a hole for inserting fabrics through the top surface.

A control panel 126 is disposed at the one side of the cabinet cover 112 to input the operation order of the fabric treating machine 100.

The drivers 150/250 may be classified into two types according to the method for generating driving power and transmitting the generated driving power to the rotary shaft 190.

The drivers 150/250 comprise a motor which generates a driving power. The drivers 150/250 may be classified according to the connecting method that the motor connects with the rotary shaft 190.

The drivers 150/250 may be classified a direct driving motor 251, which is directly connected to the rotary shaft 190, and a indirect driving motor 151, which is connected to a pulley 154 connected to the rotary shaft 190 by a belt 153.

The direct driving motor 251 is described later referring to FIG. 4 and FIG. 5.

Either the direct driving motor 251 or the indirect driving motor 151 may be applied to the fabric treating machine 100 according to the specification of products.

Figure 3:
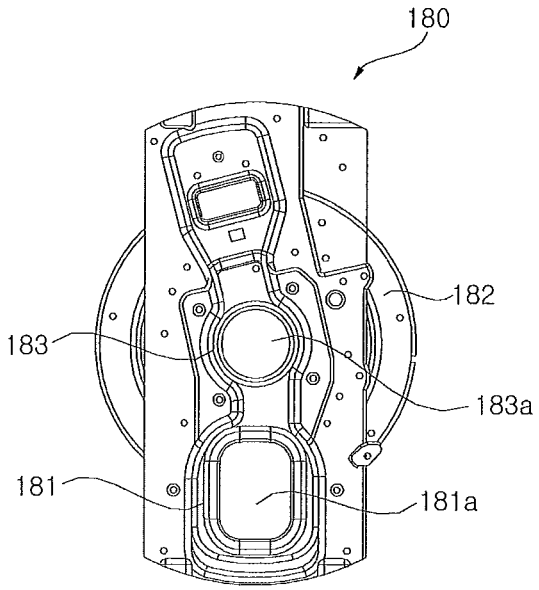
FIG. 3 illustrates a top view of the connector shown in FIG. 2.

FIG. 3 illustrates a top view of the connector shown in FIG. 2.

Referring to FIG. 2 and FIG. 3, a connector 180 is disposed at the bottom surface of the outer tub 125 for the drivers 150/250 to be connected with or to be placed on.

The connector 180 comprises a bracket which is fixed on the bottom surface of the outer tub 125. The connector 180 may be connected to the bottom surface of the outer tub 124 by bolts.

The connector 180 may be formed for the drivers 150/250 to be disposed at either the center or the off-center position of the connector 180 optionally.

If the drivers 150/250 are the direct driving motor 251, the drivers 150/250 may be connected to the rotary shaft 190 by being disposed at the center of the connector 180.

If the drivers 150/250 are the indirect driving motor 151, the drivers 150/250 may be disposed at the separated position from the center in one side direction.

The connector 180 according to the present invention is formed to be able both for the direct driving motor 251 and for the indirect driving motor 151 to be installed.

Referring to FIG. 3, the connector 180 comprises a direct driver placement 183 and an indirect driver placement 181. The direct driver placement 183 is formed for the direct driving motor 251 to be placed on the center of the connector 180. And the indirect driver placement 181 is formed for the indirect driving motor 151 to be placed on the separated position with the predescribed distance from the center.

The indirect driver placement 181 may be extended from the direct driver placement 183 toward the both sides.

The direct driver placement 183 may comprise a through hole 183*a* which the shaft of the direct driving motor 151 (not shown) passes through. After the direct driving motor 152 is placed on the direct driver placement 183, the direct driving motor 152 can be fixed on the direct driver placement 183 by extra bolts.

Connecting holes which are connected with the bottom surface of the outer tub 125 by bolts or screws may be formed at the direct driver placement 183.

A guide groove 181*a* which is formed concave toward the outer tub 125 for the indirect driving motor 151 to be placed on the indirect driver placement 181.

Connecting holes which are connected with the bottom surface of the outer tub 125 by bolts or screws may be formed at the indirect driver placement 181.

A concave groove (not shown) may be formed to the bottom surface of the outer tub 125 in order to be matched to the guide groove 181*a*. Generally a plurality of ribs may be formed on the bottom surface of the outer tub 125, but part of ribs may be removed so as to contact the connector 180.

The connector 180 more comprises the reinforcement part 182 which is extended from the direct driver placement 183 toward the radial direction.

The reinforcement part 182 is a part for increasing the stiffness by adding the contact area with the bottom surface of the outer tub 125.

While the present invention describes that the reinforcement part 182 is circular in shape, it may be possible that other shapes are applied to the shapes of the reinforcement part 182 in scope which is satisfied with the stiffness reinforcement.

Connecting holes may be formed to the reinforcement part 182 to be connected with the bottom surface of the outer tub 125 by screws.

As stated above, both the indirect driving motor 151 and the direct driving motor 251 are able to be installed to the connector 180 which is disposed bottom surface of the outer tub 125.

First, the case that the indirect driving motor 151 is disposed bottom surface of the outer tub 125 is described referring to FIG. 2.

In case of installing the indirect driving motor 151, the pulley 153 is connected to the rotary shaft 190 and a bearing housing 154 is able to be disposed between the pulley 153 and the rotary shaft 190.

Because the bearing housing 154 is connected with the rotary shaft 190, the bearing housing 154 is arranged at the center and may be placed to the direct driver placement 183. The bearing housing 154 may be fixed to the connector 180 by screws.

The indirect driving motor 151 is placed on the separated position with the predescribed distance from the center, and is connected to the pulley 153 by the belt 152.

The indirect driving motor 151 may be placed on the indirect driver placement 181 of the connector 180. The indirect driving motor 151 may be seated on the guide groove 181*a* which is formed to the indirect driver placement 181.

Figure 4:
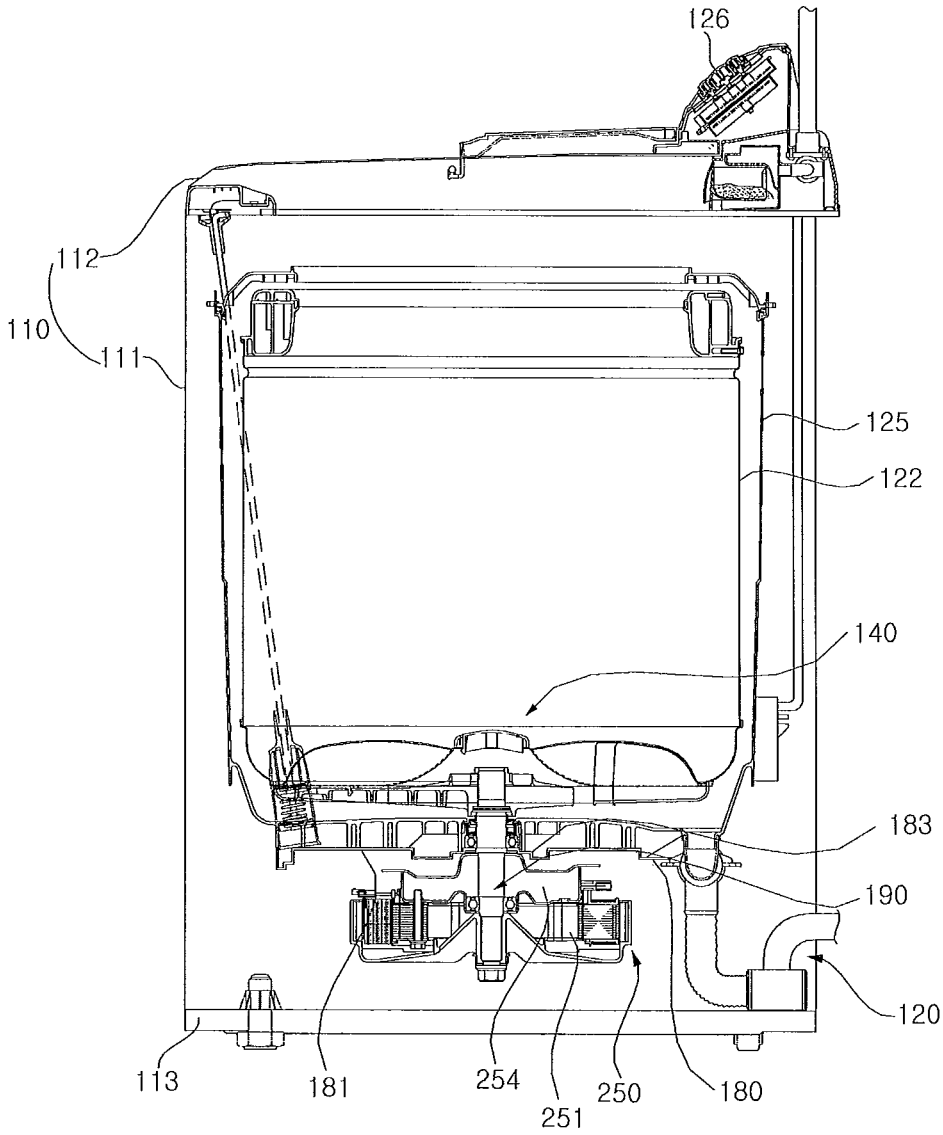
FIG. 4 is a longitudinal section view which illustrates the fabric treating machine comprising a direct driving motor according to an exemplary embodiment of the present invention.
Figure 5:
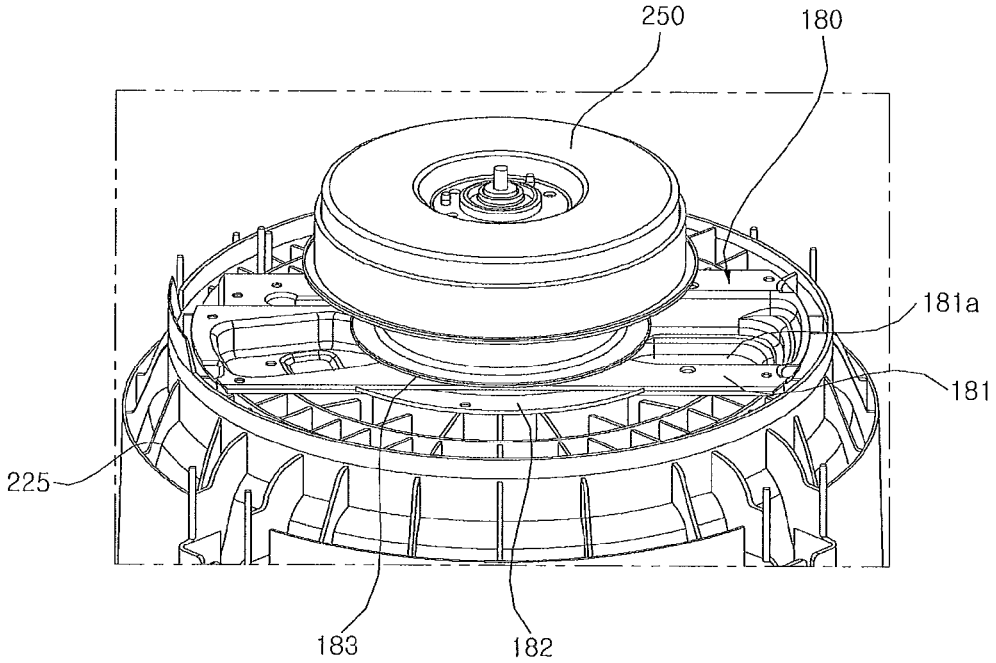
FIG. 5 is a perspective view which illustrates the connection of the connector and the driver shown in FIG. 4.

FIG. 4 is a longitudinal section view which illustrates the fabric treating machine comprising a direct driving motor according to an exemplary embodiment of the present invention, and FIG. 5 is a perspective view which illustrates the connection of the connector and the driver shown in FIG. 4.

Meanwhile, the case that the direct driving motor 251 is disposed bottom surface of the outer tub 125 is described referring to FIG. 4 and FIG. 5.

Because the connector 180 according to the present invention is formed not only for the indirect driving motor 151 but for the direct driving motor 251 so as to be installed, the direct driving motor 251 can be disposed without change of the outer tub 125 or the connector 180.

The direct driving motor 251 is placed at the center, because the direct driving motor 251 is combined with the rotary shaft 190 directly. The direct driving motor 251 is placed to the direct driver placement 183, and the direct driving motor 251 is connected to the rotary shaft 190 directly.

The direct driving motor 251 includes a bearing housing 254, and a bearing which supports the rotary shaft 190 is inserted in the bearing housing 254.

One side of the bearing housing 254 may be placed to the direct driving placement 183. The bearing housing 254 may be connected and fixed by screws after placed to the direct driving placement 183.

The shaft of the direct driving motor 251 is inserted through the through hole 183*a* of the direct driving placement 183 and may be connected to the rotary shaft 190.

As stated above, the fabric treating machine according to the present invention can install both the direct driving motor 151 and the indirect driving motor 251 to the same outer tub 125. Because the common use of the outer tub is possible needless to produce the outer tub 125 separately, the connecting method of the driving part, there are the advantages that the cost is reduced and productivity and assembly are improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fabric treating machine comprising:

a cabinet which includes a hole for inserting fabrics through the top surface;

an outer tub which is disposed inside of the cabinet to accommodate wash water;

an inner tub which is disposed inside of the outer tub to accommodate fabric; and a connector coupled to a bottom surface of the outer tub, the connector comprising:

a first placement provided at a substantially center of the connector for a direct driving motor to be mounted thereon;

a second placement provided at an off center of the connector for an indirect driving motor to be mounted thereon; and a reinforcement part extended radially outward from the first placement, wherein the reinforcement part is in contact with the bottom surface of the outer tub to increase a contact area between the connector and the bottom surface of the outer tub, and wherein one of the direct driving motor or the indirect driving motor drives the inner tub.

2. The fabric treating machine of claim 1, wherein the connector comprises a bracket which is fixed on the bottom surface of the outer tub.

3. The fabric treating machine of claim 1, further comprising:

a pulley connected to the rotary shaft; and a belt configured to transmit a driving force of the indirect driving motor to the pulley.

4. The fabric treating machine of claim 1, wherein the connector further comprises a guide groove forming a concave toward the bottom surface of the outer tub.

5. The fabric treating machine of claim 4, wherein a concave groove is provided at the bottom surface of the outer tub, corresponding to the guide groove.

6. The fabric treating machine of claim 1, wherein the reinforcement part is circular in shape.

7. The fabric treating machine of claim 1, wherein the reinforcement part comprises a flat surface being face-contacted with the bottom surface of the outer tub.

8. The fabric treating machine of claim 4, wherein the guide groove extends radially outward from the first placement in a first direction, and wherein the guide groove also extends radially outward from the first placement in a second direction substantially opposite to the first direction, the second placement provided at a portion of the guide groove extending in the first direction.

9. The fabric treating machine of claim 1, further comprising:

a bearing housing; and at least one bearing disposed in the bearing housing and supporting a rotary shaft to be rotated, wherein an upper side of the bearing housing is placed to the first placement and a lower side of the bearing housing faces the direct driving motor.

10. The fabric treating machine of claim 1, further comprising:

a rotary shaft rotated by the direct driving motor or the indirect driving motor, and rotating the inner tub, wherein a through hole is formed at the first placement through which the rotary shaft passes.

* * * * *